United States Patent [19]

Morini

[11] Patent Number: 4,960,545

[45] Date of Patent: Oct. 2, 1990

[54] DEVICE FOR FEEDING A CARBURATION ENGINE IN SPECIAL OPERATING CONDITIONS

[76] Inventor: Marco Morini, Via Ponte Romano 108, I. 11027 Saint Vincent, Italy

[21] Appl. No.: 406,572

[22] Filed: Sep. 13, 1989

[30] Foreign Application Priority Data

Sep. 30, 1988 [IT] Italy ..... 67875 A/88

[51] Int. Cl.[5] ..... F02M 1/06

[52] U.S. Cl. ..... 261/41.5; 261/121.3; 261/DIG. 19; 261/DIG. 74; 123/179 G

[58] Field of Search ..... 261/41.3, 41.5, DIG. 19, 261/DIG. 74, 121.3; 123/179 G

[56] References Cited

U.S. PATENT DOCUMENTS

| | | | |
|---|---|---|---|
| 2,130,666 | 9/1938 | Coffey | 123/179 G |
| 3,125,084 | 3/1964 | Hall | 123/179 G |
| 3,544,083 | 12/1970 | Currie | 261/41.5 |
| 3,614,945 | 10/1971 | Schlagmuller et al. | 123/179 G |
| 3,704,702 | 12/1972 | Aono | 123/179 G |
| 3,963,808 | 6/1976 | Garcea | 261/123.3 |
| 4,108,123 | 8/1978 | Ito et al. | 123/179 G |
| 4,124,662 | 11/1978 | Morita | 261/DIG. 74 |
| 4,144,861 | 3/1979 | Yamashita et al. | 123/179 G |
| 4,465,461 | 8/1984 | Morini . | |
| 4,480,618 | 11/1984 | Kamifuji et al. | 123/179 G |
| 4,554,896 | 11/1985 | Songawa | 261/DIG. 8 |

*Primary Examiner*—Tim Miles

*Attorney, Agent, or Firm*—Young & Thompson

[57] ABSTRACT

A unit intended to supply gasoline and air mixture to an internal combustion engine in special operation conditions, such as the operation at the minimum speed, the start period, the operation as motor-brake and/or the acceleration, comprises a main air intake in the form of a venturi tube defining a restricted cross section, intended to be connected to an intake conduit downstream the carburetor shutter, a jet for the supply in the operation at the minimum speed, which has an own air intake and opens in the restricted cross section of the main air intake, a jet for the operation in the start period, which has an own air intake and opens in the main air intake dowstream the restricted cross section thereof, and two solenoid valves arranged to independently cut off, when activated, the one or the other jet or both. Both the jet for supply during the operation at the minimum speed and the jet for supply during the start period comprise each a vertical tube which plunges in the constant level bowl of the carburetor and is provided with a fuel nozzle, and this verical tube is internally subdivided, on a part of its height, by a dividing wall which defines a section of the tube which communicates with the own air intake to the jet.

6 Claims, 3 Drawing Sheets

DEVICE FOR FEEDING A CARBURATION ENGINE IN SPECIAL OPERATING CONDITIONS

BACKGROUND OF THE INVENTION

This invention refers to a unit intended to supply gasoline and air mixture to an internal combustion engine in special operating conditions, such as the operation at minimum speed, the start period, the operation as motor-brake and/or the acceleration.

In the normal operating conditions, namely when the engine runs at a sufficiently high and substantially constant speed, one or more elementary carburetors, each of which comprises a choke shaped as a venturi tube, a shutter and a jet supplied by a constant level fuel bowl, are suitable for supplying to an internal combustion engine a gasoline and air mixture sufficiently homogeneous in order to ensure a correct operation, with normal performances and consumption, and a combustion complete enough for avoiding an excessive pollution of the ambient. On the contrary, these conditions cannot be satisfied by elementary carburetors in the special operating conditions pointed out, and for this reason the carburetors are generally provided with special devices, one for feeding at the minimum speed, another for feeding in the start period and further, if needed, an accelerator pump. In certain cases the device for feeding at the minimum speed is provided with aa auxiliary device intended to suppress its action when the engine acts as a motor-brake. However said devices, which are substantially independent from each other, considerably complicate the structure of the carburetor, and moreover, in the presently known embodiments, these devices are not capable of supplying to the engine a mixture homogeneous enough and correctly proportioned, whereby, when they are operative, the engine still runs with relatively high consumption and low efficiency, and it gives rise to considerable ambient pollution.

More particularly, the device for feeding at the minimum speed is generally embodied by an outlet which delivers gasoline in the intake conduit downstream the carburetor shutter. The thus introduced gasoline cannot pulverize and vaporize enough before it comes to the engine cylinders. The device for start has a structure similar to that now described of the device for feeding at the minimum speed, and then it shows similar drawbacks, or even it comprises a special little additional carburetor, but this is an excessively complicated and expensive solution. The accelerator pump, when foreseen, requires complicated mechanical or pneumatic devices for its actuation, and moreover it supplies the gasoline at a very low pressure and therefore in conditions unsuitable for an effective pulverization.

SUMMARY OF THE INVENTION

The object of this invention is to propose a unit intended to be added to an elementary single or multiple carburetor in order to feed the engine in special operating conditions, wherein the different operations are suitably coordinated to each other, and which, although with a substantially simple structure, ensures the supply to the motor of a homogeneous gasoline and air mixture wherein the gasoline is suitably proportioned and effectively pulverized and vaporized, so that even in the special operating conditions the engine can run with satisfactory performances and consumption and does not give rise to excessive ambient pollution.

This object is attained, according to the invention, mainly in that the unit comprises: a main air intake in the form of a venturi tube defining a restricted cross section, intended to be connected to an intake conduit downstream the carburetor shutter; a jet for the supply in the operation at the minimum speed, having at least one own air intake and opening in the restricted cross section of said main air intake; a jet for the operation in the start period, comprising at least one own air intake and opening in said main air intake downstream the restricted cross section thereof; and two solenoid valves arranged to independently cut off, when activated, the one or the other jet or both.

Thanks to this feature, in the special conditions of operation a gasoline and air mixture is introduced in the intake of the engine downstream the shutter of the carburetor, said mixture being formed in the main air intake of the unit and being composed of sucked air and of a mixture of gasoline and air formed in advance within the jets, which are provided of their own air intakes. In this way the gasoline is subjected to repeated mixing operations before it is forwarded to the intake of the engine, and therefore it may attain a high degree of pulverization and vaporization. Moreover, thanks to the repeated mixing operations, there are available several component parts which may be setup in order to obtain a correct dosing of the mixture in the different operation conditions. The solenoid valves allow to cut off the action of the jet for supply during the operation at the minimum speed, and/or the jet for supply during the start period, when this action is not wanted.

According to an important development of the invention, both the jet for supply during the operation at the minimum speed and the jet for supply during the start period comprise each a vertical tube plunging in the constant level bowl of the carburetor and provided with a fuel nozzle, and this tube is internally subdivided by a dividing wall in order to define a section communicating with the own air intake of the jet. In this way, the air sucked through the air intake of each jet is made to gurgle along a certain height within the gasoline which flows through the jet, thus favoring the vaporization of the gasoline.

According to another feature of the invention, at least said dividing wall included in the jet for supply during the start period extends for a substantial part of the height of the corresponding tube, thus defining a section of relatively important capacity which communicates with the own air intake of the jet. In this way a fuel reserve is made available for being sucked without any noticeable resistance in order to supply an additional amount of fuel during the initial operation period of the jet, namely during the more critical operation period of the engine during start.

According to a further feature of the invention, at least one of the jets also has another own air intake arranged for supplying air to the gasoline and air mixture already formed in the jet. In this way the number of mixing operations to which the gasoline is subjected increases, to the advantage of the pulverization and vaporization.

According to still another feature of the invention, the vertical tube of at least one jet is surrounded by a second vertical tube which plunges in the constant level fuel bowl of the carburetor, and this second tube is closed at its lower end by a bottom provided with a calibrated hole, and is open at its top end. This second vertical tube defines, along with the vertical tube of the jet, a gap wherein a variable gasoline level lower than the constant level in the fuel bowl establishes, this variable level depending upon the delivered gasoline flow. This offers a further control element in order to setup for each operation condition the dosing considered more suitable.

Finally, according to a further feature of practical nature of the invention, said main air intake, the jets and their own air intakes form an integral constructive member, to which the calibrated nozzles needed and, if foreseen, the second vertical tubes are added.

BRIEF DESCRIPTION OF THE DRAWINGS

These and other features and advantages of the invention will appear more clearly from the following description of an embodiment, to be construed as a non-limitative example, which is diagrammatically shown in the accompanying drawings, wherein.

Figure 2:
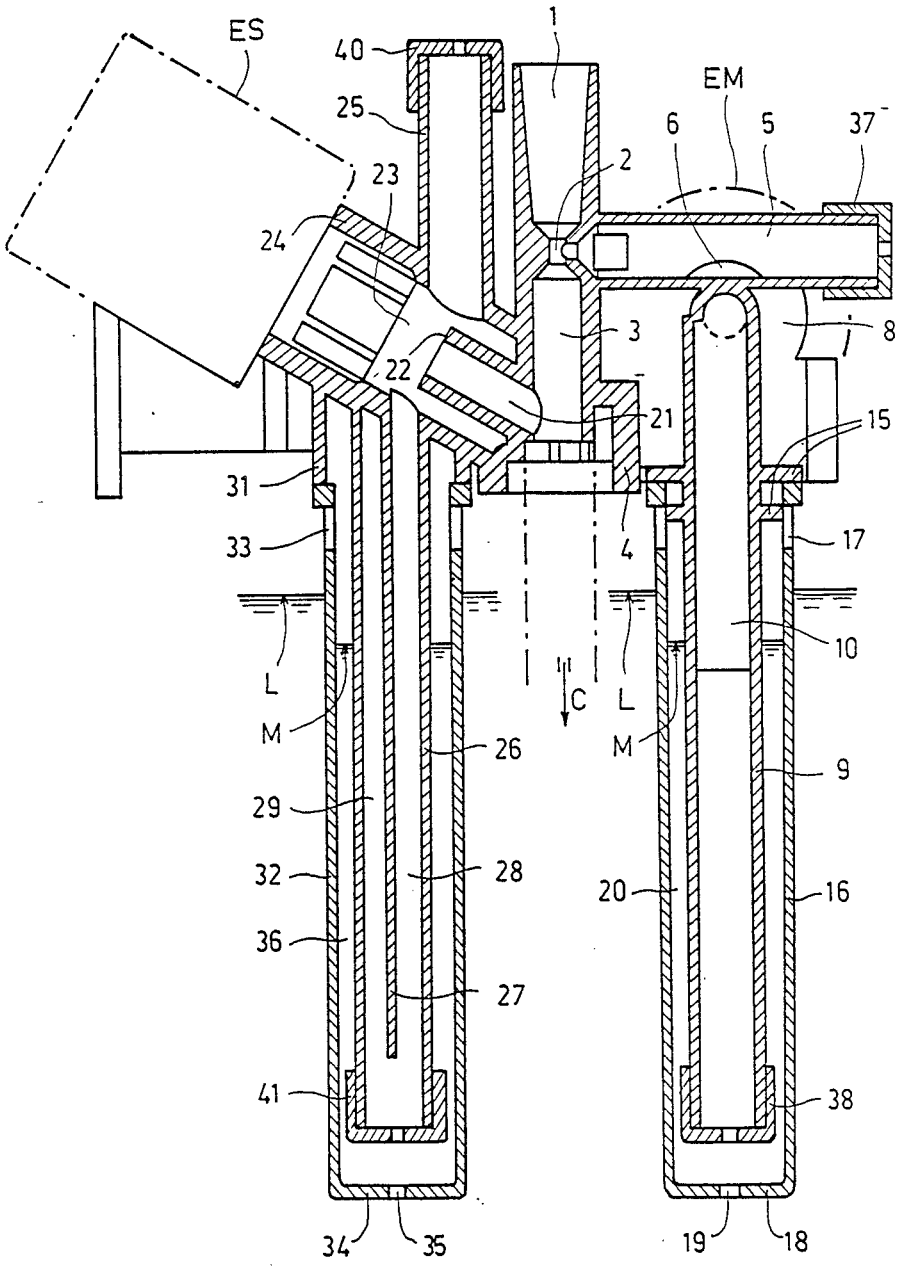
FIG. 2 shows a vertical cross section thereof, taken along the broken line II—II of FIG. 1.
Figure 5:
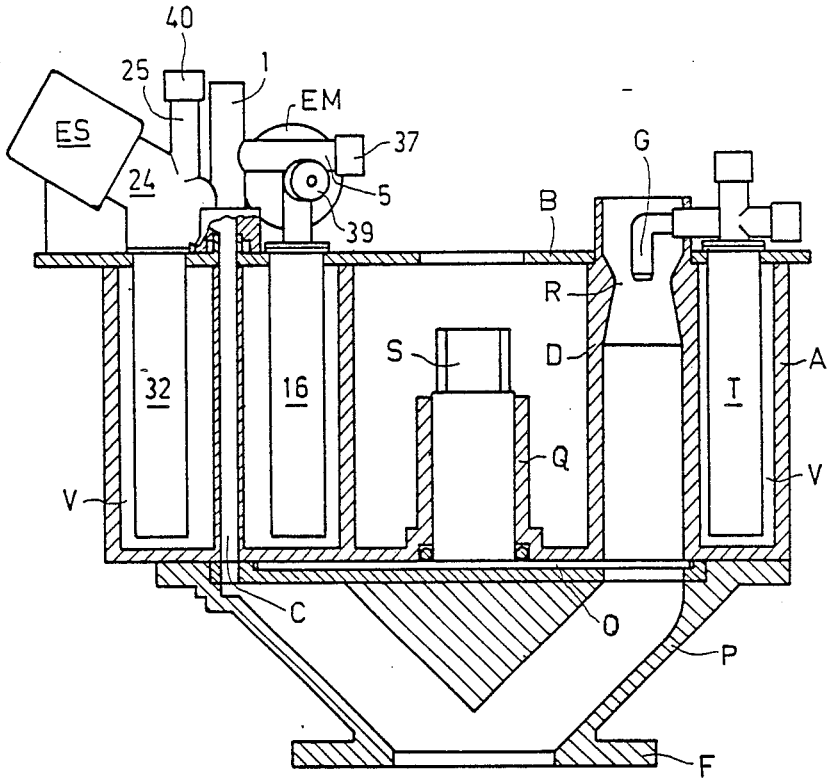
FIG. 5 diagrammatically shows the cross section of a carburetor provided with the unit according to the invention. cl DESCRIPTION OF A PREFERRED EMBODIMENT Referring at first to FIG. 5, a carburetor (which in this example is substantially of the kind described in U.S. Pat. No. 4,465,641) comprises a body A closed at top by a cover B and forming a fuel bowl V. Within the fuel bowl V, by means of devices per se well known and not described here, a constant level of gasoline is maintained. The carburetor has a rotatable shutter 0 controlled by means of a shaft S journalled in a hub Q of body A. Under the body A and the shutter 0 extends a manifold P which ends with a flange F intended to be connected to the intake (not shown) of an internal combustion engine. The carburetor body A forms a choke shaped as a venturi tube D having a restricted cross section R, wherein is located the spout G of a jet connected to a supply tube T which plunges in the fuel bowl V. These latter parts serve for supplying the engine during the normal operation conditions, and they do not concern this invention. The unit according to the invention, described later on and designated by numeric references, is mounted onto the carburetor cover E, with certain parts (tubes 16, 32) plunging in the fuel bowl V. This unit communicates with a conduit C of body A, which opens at its lower end in the manifold P without being controlled by the shutter 0.

The unit according to the invention comprises a main air intake substantially shaped as a venturi tube with a restricted cross section 2. The restricted cross section divides the main air intake in an external region 1, communicating with the ambient air, and an internal region 3 which ends with a union 4 intended to communicate with the conduit C of body A, or in any other way to be put in communication with the intake of the engine downstream the carburetor shutter. The supply devices for the operation at the minimum speed and for the start period, which are separately described in the following, open in said main air intake 1-3. The unit according to the invention is shown in a unfolded representation corresponding to the cross section of FIG. 2.

Figure 3:
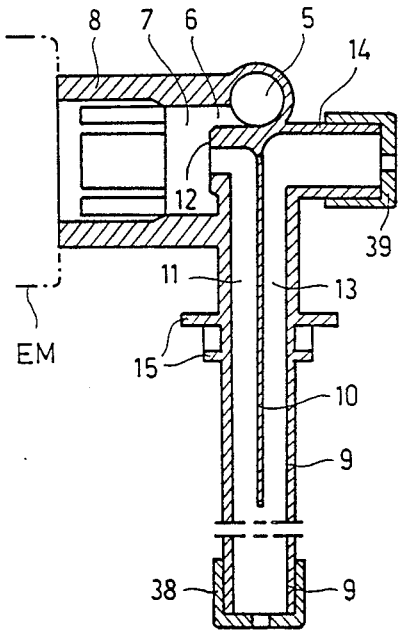

The device for operation at the minimum speed comprises a conduit 5 (FIGS. 2 and 3) which at one end opens in the restricted cross section 2 of the main air intake, and at the opposite end communicates with the ambient air by forming a primary air intake provided with a primary air nozzle 37. An opening 6 communicates conduit 5 with a chamber 7 forming 10 the peripheral portion of a union 8 for a solenoid valve EM, per se well known and therefore not described here in detail. A first vertical tube 9 extends downwards from union 8 and it is provided at its lower end with a fuel nozzle 38. Tube 9 is subdivided along a certain height from the top end thereof by a dividing wall !0, which defines two sections and 13. The inner section 11 opens in chamber 7 by forming a valve seat 12 which may be closed by a valve head (not shown) of solenoid valve EM. The external section 13 communicates with the ambient air by forming a secondary air intake 14 provided with a secondary air nozzle 39. The vertical tube 9 has two flanges 15, to which is connected a second vertical tube 16 (FIG. 2), which along with the vertical tube 9 defines a gap 20. Gap 20 has at its top end some openings 17, and the lower end of tube 16 is closed by a bottom 18 provided with a calibrated hole 19. The vertical tube 16 is intended to be plunged into the constant level fuel bowl V of the carburetor, with the openings 17 situated over the constant gasoline level L in the fuel bowl.

The operation of this device for running the engine at the minimum speed is as follows. When the carburetor shutter 0 is closed in order to run the engine at the minimum speed, in the engine intake, the manifold P and the conduit C establishes a relatively high underpressure which causes air to enter through the main air intake 1. A underpressure still higher then establishes in the restricted cross section 2 and conduit 5, causing primary air to enter through the air nozzle 37, and through opening 6 this underpressure extends to chamber 7. If the solenoid valve EM is in such position as not to close the valve seat 12, the underpressure also extends from chamber 7 inside the vertical tube 9, and causes gasoline to enter through the fuel nozzle 38 and secondary air to be sucked through the secondary air nozzle 39. This secondary air flows downwards in section 13 of tube 9 until it reaches the end of the dividing wall 10, then it flows upwards in section 11 by gurgling within the gasoline entered through the fuel nozzle 38. The thus formed gasoline and air mixture arrives, through chamber 7 and opening 6, to conduit 5, and therein it further mixes with the primary air entered through the primary air nozzle 37. The resulting mixture is delivered in the restricted cross section 2 of the main air intake 1, and therein it further mixes with the air sucked through said main air intake. Then the mixture is forwarded, through conduit C, to the engine intake.

As it may be remarked, the sucked gasoline is subjected to repeated mixing operations with the air, and then it is forwarded to the engine intake in a homogeneous, highly pulverized and vaporized condition, thus ensuring optimal operation conditions of the engine at the minimum speed.

By suitably proportioning the different parts of the device, and particularly the nozzles 37, 38 and 39, one is allowed to establish the more favorable composition (dosing) of the thus supplied mixture. Furthermore, in gap 20 establishes a gasoline level M which is lower than the constant gasoline level L in the fuel bowl V, due to the head loss suffered by the gasoline flow which, before arriving to the fuel nozzle 38, is obliged to traverse the calibrated hole 19. The calibrated hole 19 offers therefore an additional element which may be proportioned in order to favorably modify the dosing. However this additional control element is not absolutely necessary, so the second tube 16 may in certain cases be omitted. In a similar way, the mixing of gasoline in section 11 of the vertical tube 9 with the secondary air sucked through the secondary air nozzle 39 may in certain cases be considered sufficient in order to forward the mixture to the restricted cross section 2 of the main air intake 1, and in those cases the primary air intake with the corresponding nozzle 37 may be omitted.

Figure 1:
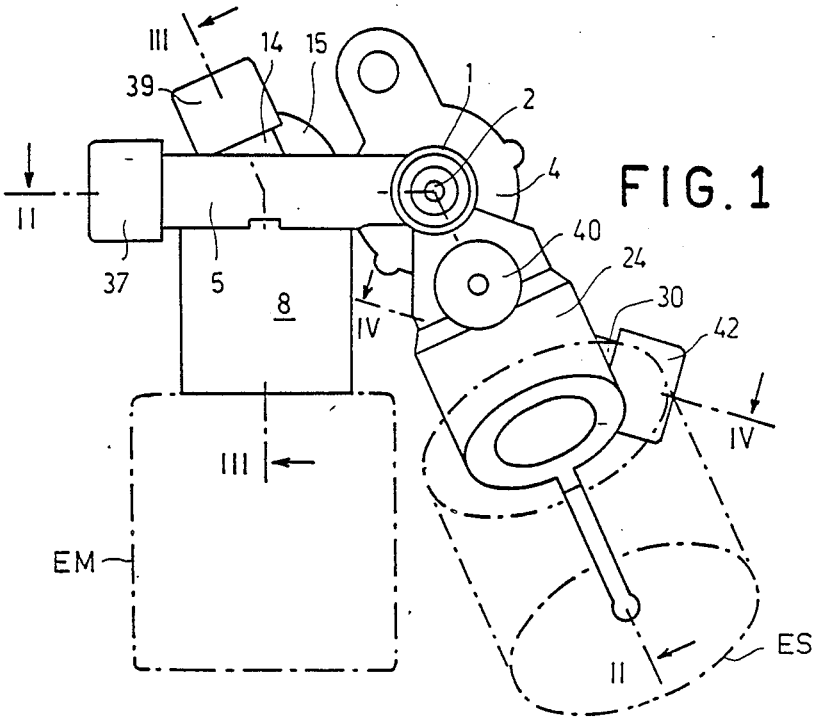
FIG. 1 shows in a plan view on a somewhat enlarged scale the unit according to the invention for supplying an internal combustion engine in special operation conditions.
Figure 4:
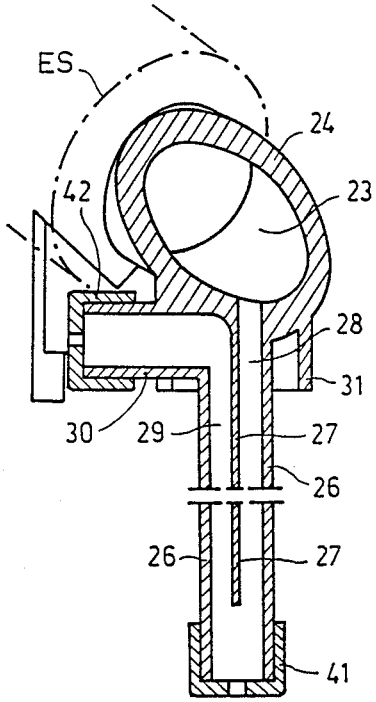
FIGS. 3 and 4 show partial and broken cross sections thereof, taken along lines III—III and IV—IV, respectively, of FIG. 1.

The device for supplying the engine during the start condition comprises a conduit 21 which at its inner end opens in the inner region 3 of the main air intake, and at the outer end opens in a chamber 23 (FIGS. 2 and 4) forming the inner portion of a union 24 for a solenoid valve ES (per se well known and therefore not described here in detail), and forms there a valve seat 22 which may be closed by a valve head (not shown) of solenoid valve ES. In chamber 23 also opens a primary air intake 25 provided with a primary air nozzle 40. A first vertical tube 26 extends downwards from union 24 and it is provided at its lower end with a fuel nozzle 41. Tube 26 is subdivided along a certain height from the top end thereof by a dividing wall 27, which defines two sections 28 and 29. The inner section 28 opens in chamber 23, whereas the external section 29 communicates with the ambient air by forming a secondary air intake 30 provided with a secondary air nozzle 42. The union 24 has a flange 31, to which is connected a second vertical tube 32 (FIG. 2), which along with the vertical tube 26 defines a gap 36. Gap 36 has at its top end some openings 33, and the lower end of tube 32 is closed by a bottom 34 provided with a calibrated hole 35. The vertical tube 32 is intended to be plunged into the constant level fuel bowl V of the carburetor, with the openings 33 situated over the constant gasoline level L in the fuel bowl.

The operation of this device for supplying the engine during the start period is as follows. When starting the carburetor shutter 0 is closed and in the engine intake, the manifold P and the conduit C establishes a relatively high underpressure which causes air to enter through the main air intake 1. Due to the presence of the restricted cross section 2 this underpressure exists in the inner region 3 of the main air intake and extends to conduit 21. If the solenoid valve ES is in such position as not to close the valve seat 22, the underpressure causes primary air to enter through the primary air nozzle 40. Moreover the underpressure also extends from chamber 23 inside the vertical tube 26, and causes gasoline to enter through the fuel nozzle 41 and secondary air to be sucked through the secondary air nozzle 42. This secondary air flows downwards in section 29 of tube 26 until it reaches the end of the dividing wall 27, then it flows upwards in section 28 by gurgling within the gasoline entered through the fuel nozzle 41. The thus formed gasoline and air mixture arrives to chamber 23, wherein it further mixes with the primary air sucked through the primary air nozzle 40. Then the mixture arrives, through conduit 2!, to the inner region 3 of the main air intake 1, and therein it further mixes with the air sucked through said main air intake. Then the mixture is forwarded, through conduit C, to the engine intake.

As it may be remarked, the sucked gasoline is subjected to repeated mixing operations with the air, and then it is forwarded to the engine intake in a homogeneous, highly pulverized and vaporized condition, thus ensuring optimal operation conditions of the engine during the start period.

By suitably proportioning the different parts of the device, and particularly the nozzles 40, 41 and 42, one is allowed to establish the more favorable composition (dosing) of the thus supplied mixture. Furthermore, in gap 36 establishes a gasoline level M which is lower than the constant gasoline level L in the fuel bowl V, due to the head loss suffered by the gasoline flow which, before arriving to the fuel nozzle 41, is obliged to traverse the calibrated hole 35. The calibrated hole 35 offers therefore an additional element which may be proportioned in order to favorably modify the dosing. However this additional control element is not absolutely necessary, so the second tube 32 may in certain cases be omitted. In a similar way, the mixing of gasoline in section 28 of the vertical tube 26 with the secondary air sucked through the secondary air nozzle 42 may in certain cases be considered sufficient in order to forward the mixture to the inner region 3 of the main air intake 1, and in those cases the primary air intake 25 with the corresponding nozzle 40 may be omitted.

It should be remarked that the dividing wall 27 extends up nearly to the lower end of the vertical tube 26, and therefore the section 29 of this tube has a considerable capacity. At the first start of the operation, namely before a underpressure establishes in the engine intake, section 29 is replete with gasoline up to the constant gasoline level L of the fuel bowl. Therefore, there is available a noticeable reserve of fuel which, when the engine is started, may be sucked without any substantial resistance, because it has not to traverse any nozzle. This amount of gasoline forms an additional supply which is forwarded to the engine when starting, and therefore it is equivalent to the injection of an accelerator pump automatically energized when starting the engine.

During the operation periods in which the starter device should not be active, the solenoid valve ES should be switched in the position in which it closes the valve seat 22. The action of the starter device is then completely inhibited. This control may be done manually by means of a switch controlling the solenoid valve ES, or automatically by means of an electric or electronic circuit arranged to do this when suitable operation conditions are verified, namely when the engine has reached a sufficiently high temperature.

The starter device automatically behaves as an accelerator pump when it starts operating, and this allows using this device as an accelerator pump even when the start period has elapsed and, therefore, the solenoid valve ES closes the valve seat 22. In this case, the solenoid valve ES is momentarily switched to its open position, and this allows the amount of gasoline contained in section 29 of the vertical tube 26 to be sucked without any resistance, thus affording an additional supply. Therefore, when the solenoid valve ES is controlled by an electric circuit, this latter may also have the task of momentarily energizing the solenoid valve ES each time the operating conditions of the engine suggest that it is suitable to deliver an additional supply. But, even in the absence of such an electric control circuit, the same action may be entrusted to any known means usually employed for actuating an accelerator pump.

When the ambient temperature is not excessively low, the starter device is capable of delivering to the engine the supply needed without any intervention of the device for the operation at the minimum speed. Therefore, in these conditions the solenoid valve EM may be switched to the position of closure, in order to cut off the device for supply at the minimum speed, when the solenoid valve ES, which actuates the starter device, is energized. However, when the ambient temperature is very low, it is of advantage that both the devices for supply at the minimum speed and for the start period are simultaneously operative during start. This is obtained by switching both solenoid valves EM and ES to the open position. A particularly increased supply is then delivered to the engine, thus facilitating start in the more difficult conditions. In this case it is suitable that the solenoid valve EM, open at first start, be closed when the engine reaches a sufficient temperature, whereas, when a higher temperature is attained, the solenoid valve ES is closed as usual, and simultaneously the solenoid valve EM is opened.

The provision of the solenoid valve EM also allows to easily obtain an operation condition of socalled "cut off", where the engine acts as a brake. To this aim it is sufficient that the solenoid valve EM is closed as long as the engine speed overcomes a certain limit and when the underpressure in the engine intake, or any other suitable parameter, reveals that the engine is acting as a brake. Also this action may advantageously be entrusted to a circuit controlling the solenoid valves.

From the structural point of view, of course, the different component parts described could be separately manufactured and then connected the one another in any suitable way. However it is of advantage that the component parts 1 to 34, namely the main air intake, the inner vertical tubes of the jets and the corresponding air intakes, along with the unions for the solenoid valves and the possible other structural parts of the unit, form a solid member, to which may then be applied the needed nozzles (37 to 42), the solenoid valves EM and ES and the outer vertical tubes 16 and 32, when these latter are foreseen. The solid member 1-34 may, for example, be molded of plastics.

The unit according to the invention is very compact, and the different operations thereof are coordinated to each other, thus allowing to obtain, with a minimal encumberment and without complicated structures, operation conditions better that those usually obtained. Moreover all component parts of the unit may be acceded very easily, both for setup and for cleaning.

The described unit is particularly suitable for being mounted onto a carburetor of the type comprising several chokes which are gradually uncovered by a rotary shutter, as shown, however the same unit may also be used onto any conventional one-body or two-bodies carburetor.

Different modifications, in addition to those already stated, may be foreseen with respect to the embodiment described and shown. For example, the fuel nozzles could be mounted in positions different from those shown; the tubes which have been called "vertical" could be only approximately vertical; the subdivision of the inner vertical tubes could be obtained by shaping said tubes in U-form rather than inserting therein a dividing wall.

I claim:

1. A unit intended to supply gasoline and air mixture to an internal combustion engine in special operating conditions, such as operation at minimum speed, the start period, operation as motor-brake and/or acceleration, said engine having an intake and a carburetor connected to said intake and including a shutter and a fuel bowl wherein a constant level of gasoline is maintained, wherein the unit comprises: a main air intake in the form of a venturi tube having a restricted cross section, connected to the engine intake downstream the carburetor shutter; a supply jet for operation at minimum speed, having a fuel supply and at least one own air intake and opening in the restricted cross section of said main air intake; a jet for the operation during the start period, comprising a fuel supply and at least one own air intake and opening in said main air intake downstream the restricted cross section thereof; and two solenoid valves arranged to independently cut off, when activated, the one or the other jet or both.

2. A supply unit as set forth in claim 1, wherein at least one of said jets has a second own air intake arranged for adding air to the gasoline and air mixture formed in the jet.

3. A supply unit as set forth in claim 1, wherein both the jet for supply during operation at minimum speed and the jet for supply during the start period comprise each a vertical tube plunging in the constant level bowl of the carburetor, and a fuel nozzle, and said vertical tube has an internal dividing wall extending on a part of the height of the tube, a first section and a second section defined in said tube by said dividing wall, said first section communicating with said main air intake and said second section communicating with the own air intake of the jet.

4. A supply unit as set forth in claim 3, wherein at least said dividing wall included in the jet for supply during the start period extends for a substantial part of the height of the corresponding tube, thus defining a second section of relatively important capacity which communicates with the own air intake of the jet.

5. A supply unit as set forth in claim 3, wherein at least one of said jets comprises a second tube which surrounds the vertical tube of the jet, said second tube plunging in the constant level fuel bowl of the carburetor, having at its lower end a bottom and a calibrated hole traversing said bottom, and being open at its top end.

6. A supply unit as set forth in claim 5, wherein said main air intake, said jets, said vertical tubes of the jets and said own air intakes of the jets form an integral constructive member, to which said calibrated nozzles and second tubes surrounding said vertical tubes are added.

* * * * *